United States Patent [19]

Rickard

[11] Patent Number: 5,067,780

[45] Date of Patent: Nov. 26, 1991

[54] VERTICAL FILING DEVICE

[76] Inventor: Brent N. Rickard, 5415 Via Carrizo, Laguna Hills, Calif. 92653

[21] Appl. No.: 374,009

[22] Filed: Jun. 29, 1989

[51] Int. Cl.[5] ..... B42F 7/00

[52] U.S. Cl. ..... 312/193; 211/11

[58] Field of Search ..... 312/183, 187, 190, 193; 49/496; 211/12, 184, 45, 50, 11, 51; 206/455, 425; 40/371, 372, 373, 374, 375

[56] References Cited

U.S. PATENT DOCUMENTS

| | | | |
|---|---|---|---|
| 729,076 | 5/1903 | Lee | 211/50 |
| 1,560,058 | 11/1925 | Jamieson . | |
| 1,660,823 | 2/1928 | Thometz | 211/51 |
| 1,708,017 | 4/1929 | Hunter . | |
| 1,734,168 | 11/1929 | Hunter . | |
| 1,743,669 | 1/1930 | Hunter . | |
| 1,748,714 | 2/1930 | Hunter . | |
| 2,287,005 | 6/1943 | Greaves | 211/184 |
| 2,762,737 | 9/1956 | Rosenberg | 211/50 |
| 3,623,250 | 11/1971 | Misenko | 211/11 |
| 4,111,504 | 9/1978 | Montiel . | |
| 4,164,309 | 8/1979 | Staats | 312/193 |

FOREIGN PATENT DOCUMENTS

| | | | |
|---|---|---|---|
| 0305344 | 2/1929 | United Kingdom | 211/11 |
| 1248746 | 10/1971 | United Kingdom | 49/496 |

*Primary Examiner*—Kenneth J. Dorner
*Assistant Examiner*—Gerald A. Anderson
*Attorney, Agent, or Firm*—Gordon L. Peterson

[57] ABSTRACT

A file drawer system for containing and positioning a plurality of file folders comprising a file drawer and forward and rear file positioners for positioning the file folders so that they are in an inclined position in which they are inclined rearwardly as they extend upwardly. The positioners are releasably coupled to the forward and rear walls of the file drawer, respectively. The positioners engage the forwardmost and rearwardmost file folders to urge the file folders toward the inclined position.

14 Claims, 1 Drawing Sheet

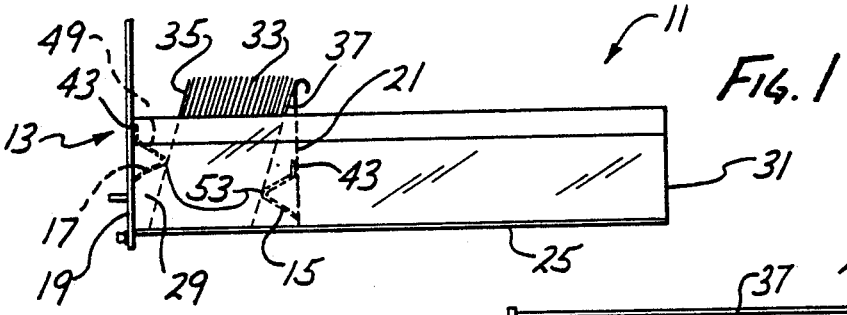
FIG. 1
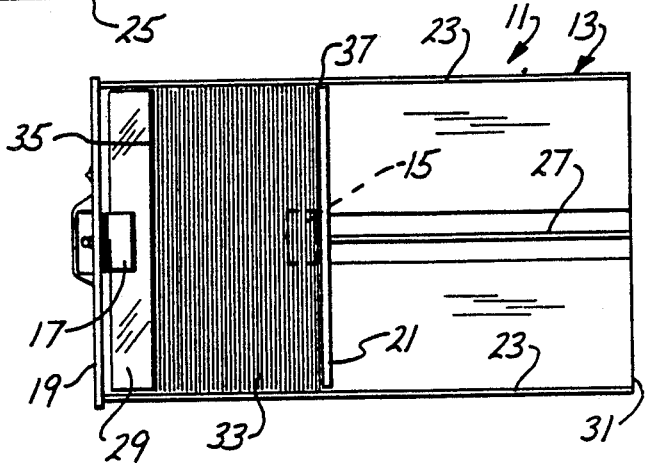
FIG. 2
FIG. 3
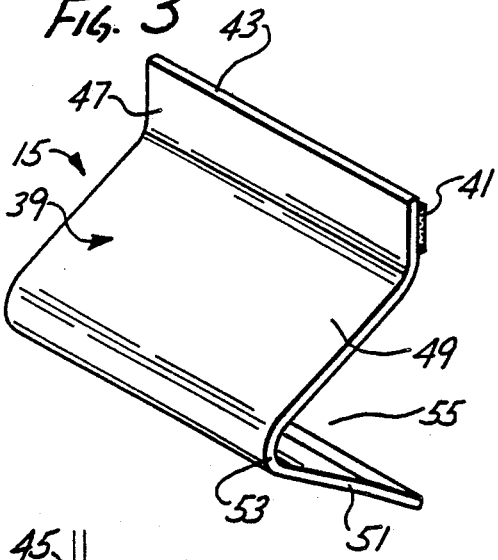
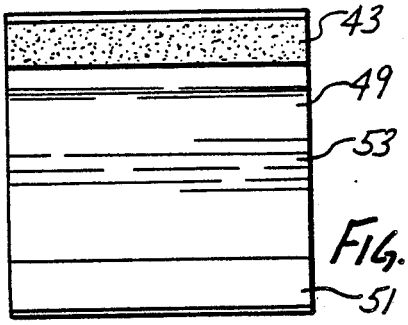
FIG. 4
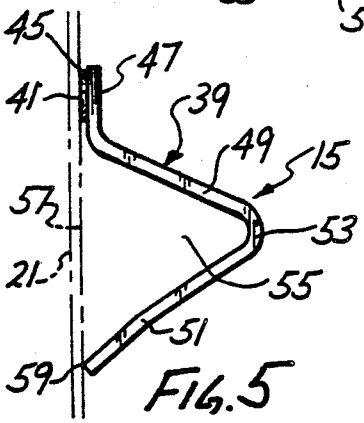
FIG. 5
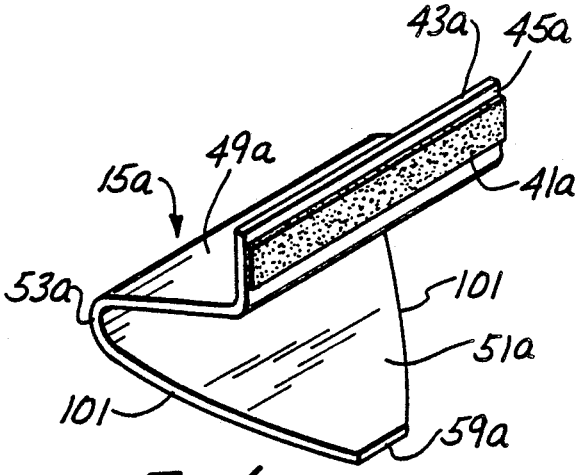
FIG. 6

VERTICAL FILING DEVICE

BACKGROUND OF THE INVENTION

This invention relates to file cabinet drawers, specifically to an improved mechanism for maintaining the file folders within such drawers in an erect or rearward slanted position for easy identification and handling. In a vertical file drawer system, file folders are placed in a generally vertical position in the file drawer, with the identification tabs uppermost. In a vertical file drawer system, the file drawers may be of the type in which the plane of the file folders is generally perpendicular to the direction of motion of the file drawer as the file drawer is opened. Alternatively, the vertical file drawer system may employ lateral file drawers in which the plane of the file folders is generally parallel to the direction of movement of the file drawer when the file drawer is opened.

In either case, the file folders in a vertical file drawer system are subject to tilting forwardly so that the identification tabs cannot be easily observed. This may be the result of various factors, such as the filing compartment being too large for the number of file folders or from the inertia of the file folders as the file drawer is opened or closed. Regardless of the cause, the inability to readily read the identification tabs is a nuisance and leads to the tabs becoming bent and torn as the observer attempts to read the tab by bending it into a more readable position.

One attempt to deal with this problem involves the use of a slidable rear wall in the file drawer which can be slid to a position to adjust the compartment size to the number of file folders being stored. Although this solution is workable, the rear wall may be difficult to adjust and must be adjusted as files are added to, and removed from, the compartment in order to prevent the undesirable tilting of the file folders. Another movable rear wall type which utilizes multiple side slots requires some strength and motion in experimental directions to free the hooks from the side slots to move the wall and reinsert the hooks into new slot positions.

It is also known to provide a block at the rear of the file drawer as shown, for example, in Jamieson U.S. Pat. No. 1,560,058. However, such a block consumes too much of the file drawer compartment, is somewhat cumbersome and bulky and does not deal with the file folder tilting problem as effectively as desired. Another attempt to deal with this problem is the placement of a heavy wire framework within the file drawer. Sturdy plastic or fiber hammocks with rigid metal cross supports are then suspended from the wire framework, and file folders are placed in the hammocks. At times the file folders are eliminated to economize on space, and the paperwork is placed directly in the hammock. In such cases, the hammock must be removed from its suspension framework or else the paperwork within it is removed without benefit of protection from separation from the rest of the file or loss from its hammock category. The principal disadvantage of the hammock type is the amount of drawer space taken up by multiple hammocks and crossbars, the complexity and time required to retrofit the supporting structure by a clerk and the substantial cost differential of such hammocks and supporting framework relative to the file positioner in this patent application.

SUMMARY OF THE INVENTION

This invention provides a file drawer system and a file positioner which overcome the problems discussed above. With this invention, one or more file positioners are employed within a filing compartment to position the file folders so that they are in an inclined position in which they are inclined rearwardly as they extend upwardly.

This invention is applicable to any vertical file drawer system, including lateral file drawers. Thus, this invention is applicable to a file drawer having a forward wall, a rear wall, at least one side wall and a bottom wall. These walls define a filing compartment which is adapted to receive the file folders, with a forwardmost and a rearwardmost of the file folders confronting the forward and rear walls, respectively.

For definitional purposes, the forward and rear walls are those walls confronted by the forwardmost and rearwardmost file folders, respectively, and this is true regardless of the direction in which the file drawer is moved between the open and closed positions. Furthermore, the forward and rear walls may be defined by movable or slidable partitions carried by the file drawer or by the rigid walls forming an integral part of the file drawer itself.

Although a single file positioner can be used, if desired, preferably, the file drawer system includes at least forward and rear file positioners. Although the file positioners may simply sit in the filing compartment of the file drawer, preferably they are coupled to the file drawer to prevent them from moving within the filing compartment as the file drawer is opened and closed. Another advantage of attaching the positioners is that they can be elevated above the bottom wall of the file drawer to locations where they are most effective and so that they consume a minimum of space within the filing compartment.

In addition, by making the coupling releasable, the position of the positioners within the filing compartment can be quickly and easily adjusted to accommodate various requirements, such as excess drawer space. Such file positioners with the releasable coupling can easily be retrofit onto existing file drawers of metal or wood and portable fiberboard storage boxes constructed to contain file folders. A releasable coupling allows the positioners to be moved, for example, to a sliding divider, if it is desired to shorten the filing compartment. Accordingly, several objects and advantages of this invention are improved office efficiency through the maintenance of file folders in a vertical or slightly rearward slanted position for easy identification of title tabs, minimizing damage from bending or tearing such tabs which would require folder replacement, immediate adjustment of the file positioner for excess drawer space and providing space for more file folders than hammock-type file holders allow in a drawer.

Preferably, at least one of the positioners has an inclined cam surface. Specifically, the inclined cam surface of the rear positioner faces forwardly and upwardly, and the inclined cam surface of the forward positioner faces rearwardly and upwardly. In these positions, the cam surfaces can cam or guide the files being inserted at opposite ends of the compartment to the free space within the compartment. By spacing these cam surfaces upwardly from the bottom wall, less volume of the filing compartment is consumed with the positioners than would be necessary if the cam surfaces extended all the way to, and rested on, the bottom wall. To help bring about positioning of the file folders in the inclined position, preferably, the cam surface of the forward positioner terminates downwardly at a location which is above the location which the cam surface of the rear positioner terminates downwardly.

Each of the file positioners may be of the same or different constructions. Although various constructions are possible, the file positioner preferably includes a body of sheet material, with the body having a flange and coupling means carried by the flange for releasably attaching the file positioner to a file drawer. By constructing the body of sheet material, the quantity of material needed for the file positioner is reduced, and the file positioner can be readily extruded, formed or cut from various materials, including plastic, sheet metal, screen material or fiberboard. The sheet material may also contain holes or slots as a means for lightening the file positioner and reducing the amount of material required for its construction.

In a preferred construction, the body includes a first segment joined to the flange and extending away from the flange and a second segment joined to the first segment by a reverse bend portion so that the first and second segments and the reverse bend portion at least partially circumscribe a region. Preferably, the flange lies generally in a plane, and the second segment extends substantially to the plane so that the second segment can engage the file drawer. This helps to support the file positioner in a sturdy fashion while minimizing the strength required for the coupling means. To further assist in providing a strong attachment, the flange preferably extends away from the region.

The first segment can be used to form the inclined cam surface. Although this can be brought about in different ways, it can result from causing the flange and the first segment to form an included obtuse angle.

Although the coupling means can take virtually any form, including threaded fasteners and mechanical quick disconnect fasteners, for the sake of economy and the ease in operation and retrofitting, the coupling means preferably includes a magnet, one form of which is a suitable length of magnetic tape. Another suitable inexpensive, releasable coupling means is hook and eye material commonly sold under the trademark Velcro. Either of these kinds of coupling means can be quickly and easily adhered to the flange by self adhesive or other means to thereby facilitate manufacture. With this construction, the coupling means is located on one side of the flange, and the first segment extends away from the flange on the other side of the flange. Thus, the file positioner provides a fast, readily adjustable means of maintaining file folders in an easily identifiable and accessible position in a file drawer.

The invention, together with additional features and advantages thereof, may best be understood by reference to the following description taken in connection with the accompanying illustrative drawing.

BRIEF DESCRIPTION OF THE DRAWING

FIG. 1 is a side elevational view of a file drawer system constructed in accordance with the teachings of this invention having a plurality of file folders contained therein.

FIG. 2 is a top plan view of the file drawer system.

FIG. 3 is a perspective view of one preferred form of file positioner.

FIG. 4 is a front elevational view of the file positioner.

FIG. 5 is an end elevational view taken from the left end of FIG. 3.

FIG. 6 is a perspective view of a second preferred embodiment of file positioner.

DESCRIPTION OF THE PREFERRED EMBODIMENT

FIGS. 1 and 2 show a file drawer system 11 which includes a file drawer 13, a rear file positioner 15 and a forward file positioner 17. The file drawer 13 is conventional and includes a forward wall 19, a rear wall 21, opposite side walls 23 and a bottom wall 25. In the form shown in FIGS. 1 and 2, the rear wall 21 is a divider mounted on a rail 27. The walls 17, 19, 23 and 25 define a filing compartment 29, and the length of the filing compartment 29 can be adjusted by movement of the rear wall 21 to a desired position along the rail 27 and affixing the rear wall in that position in a well-known manner. Of course, the file drawer 13 also has a rear wall 31 joined to the side wall 23, but in the illustrated embodiment, it is the rear wall 21 that is being used to partially define the filing compartment 29. The filing compartment 29 receives a plurality of file folders 33, including a forwardmost file folder 35 and a rearwardmost file folder 37 which confront the forward wall 19 and the rear wall 21, respectively.

In this embodiment, the file positioners 15 and 17 are identical, and so only the rear file positioner 15 is discussed in detail. Portions of the forward file positioner 17 corresponding to portions of the file positioner 15 are designated by corresponding reference numerals.

The rear file positioner 15 (FIGS. 3-5) includes a body 39 and coupling means in the form of a magnetic strip 41 for coupling the body 39 to the file drawer 13. In this embodiment, the body 39 is integrally extruded from a suitable plastic material, such as ABS, and accordingly, the cross-sectional configuration shown in FIG. 5 is continuous throughout the full length of the file positioner. Thus, the body 39 is integrally constructed of sheet material and includes a flange 43 having opposite faces or sides 45 and 47. The magnetic strip 41 is adhesively attached to the side 45 and, in this embodiment, extends for substantially the full length of the flange 43.

The body 39 has a first segment 49 joined to the flange 43 and extending away from the flange and forming an obtuse included angle with the flange. The body 39 has a second segment 51 which is joined to the first segment 49 by a reverse bend portion 53 such that the segments 49 and 51 at least partially circumscribe a region 55.

The flange 43 extends away from the region 55. The flange 43 lies generally in a plane 57 (FIG. 5), and the second segment 51 extends substantially to that plane and terminates in a terminal edge 59 substantially at that plane. In this embodiment, the second segment 51 extends beyond the plane 57 a distance approximately equal to the width of the magnetic strip 41. In this embodiment, the segments 49 and 51 are generally planar and form the sides of an essentially equilateral triangle.

Although in a broader sense, the rear file positioner 15 can be attached to any of the walls 21, 23 or 25, the particular construction illustrated is adapted for being releasably coupled to the rear wall 21, with the flange 43 extending either upwardly or downwardly. In FIG. 1, the rear file positioner 15 is releasably coupled by the magnetic strip 41 to the rear wall 21, with the flange 43 extending upwardly, and this is the preferred position for stability. When so attached, the terminal edge 59 of the segment 51 bears against the rear wall 21 as best shown in FIG. 5 to help sturdily support the rear file positioner. The magnetic strip 41 holds the file positioner 15 on the rear wall 21 and retains the file positioner 15 against pivoting about the terminal edge 59. The magnetic strip 41 is more effective as an anti-pivoting mechanism when the file positioner 15 is mounted with the flange 43 extending upwardly.

When attached to the rear wall 21, the first segment 49 forms an inclined cam surface which faces forwardly and upwardly and which is spaced from the bottom wall 25. With the forward file positioner 17 similarly magnetically attached to the forward wall 19, the first segment 49 thereof forms an inclined cam surface which faces rearwardly and upwardly and which is also spaced upwardly from the bottom wall 25. However, as shown in FIG. 1, the cam surface and reverse bend portion 53 of the forward positioner terminate above the downward termination of the cam surface and reverse bend portion of the rear file positioner 15. Although this particular construction of the forward file positioner 17 is adapted for mounting on the forward wall 19, in a broader sense, the forward file positioner can be mounted on the side wall 23, the bottom wall 25 and/or the forward wall 19.

In use, the file positioners 15 and 17 can be mounted as shown, for example, in FIG. 1. When so mounted, the forwardmost file folder 35 and the rearwardmost file folder 37 confront the walls 17 and 21, respectively, and the file positioners position the file folders 33 so that they are in an inclined position in which they are inclined rearwardly as they extend upwardly, i.e., so that the file folders 33 are in the position shown in FIG. 1. The vertical offset between the reverse bend portions 53 of the file positioners 15 and 17 tends to assure that the file folders 33 will be in this inclined position. The segments 49 or cam surfaces facilitate the insertion of the forwardmost and rearwardmost files 35 and 37 into the filing compartment 29. Of course, the locations of the file positioners 15 and 17 can be changed as desired.

FIG. 6 shows a file positioner **15*a* which is identical to the file positioner 15 in all respects not shown or described herein. Portions of the file positioner 15*a* corresponding to portions of the file positioner 15** are designated by corresponding reference numerals followed by the letter "a."

The only difference between the file positioners 15 and **15*a* is that the segment 51*a* has tapered sides 101 which extend toward each other as they extend from the reverse bend portion 53*a* to the terminal edge 59*a* to thereby define a relatively narrow terminal edge. The advantage of this construction over that shown in FIGS. 3–5 is that less plastic material is utilized. The file positioner 15*a*** is adapted to be injection molded from a suitable plastic material.

Although exemplary embodiments of the invention have been shown and described, many changes, modifications and substitutions may be made by one having ordinary skill in the art without necessarily departing from the spirit and scope of this invention.

I claim:

1. A file drawer system for containing and positioning a plurality of file folders comprising:

a file drawer having a forward wall, a rear wall, at least one side wall and a bottom wall, said walls defining a filing compartment which is adapted to receive the plurality of file folders with a forwardmost and a rearwardmost of the file folders facing the forward and rear walls, respectively;

forward and rear positioners for positioning the file folders so that they are in an inclined position in which they are inclined rearwardly as they extend upwardly when the file drawer is closed;

means for releasably coupling the rear positioner to any desired location on at least one of said side, rear and bottom walls without penetrating said one wall and with the rear positioner lying between the rear wall and the rearwardmost file folder and being engageable with the rearwardmost file folder;

means for releasably coupling the forward positioner to any desired location on at least one of said forward, side and bottom walls without penetrating the wall to which the forward positioner is coupled; and said forward positioner being between the forwardmost file folder and the forward wall and being engageable with the forwardmost file folder.

2. A system as defined in claim 1 wherein the rear positioner has an inclined cam surface which faces forwardly and upwardly and which is spaced upwardly from said bottom wall.

3. A system as defined in claim 2 wherein the forward positioner has an inclined cam surface which faces rearwardly and upwardly and which is spaced upwardly from said bottom wall.

4. A system as defined in claim 3 wherein said cam surfaces of said forward and rear positioners terminate downwardly at first and second locations, respectively, and said first location is above said second location.

5. A system as defined in claim 1 wherein the forward positioner has an inclined cam surface which faces rearwardly and upwardly and which is spaced upwardly from said bottom wall.

6. A system as defined in claim 1 wherein at least said forward positioner includes a body of sheet material, said body having a flange and said coupling means is carried by said flange.

7. A system as defined in claim 6 wherein said body includes a first segment joined to the flange and extending away from said flange and a second segment joined to the first segment.

8. A file drawer system for containing and positioning a plurality of file folders comprising:

a file drawing having a forward wall, a rear wall, at least one side wall and a bottom wall, said walls defining a filing compartment which is adapted to receive the plurality of file folders with a forwardmost and a rearwardmost of the file folders facing the forward and rear walls, respectively;

at least one file positioner for use in positioning the file folders so that they are in an inclined position in which they are inclined rearwardly as they extend upwardly;

said file positioner lying between the rear wall and the rearwardmost file folder or the forwardmost file folder and the forward wall;

said file positioner including an extruded body of plastic sheet material, said body having a flange, a first segment joined to the flange and extending away from the flange, and a second segment joined to the first segment by a reverse bend portion; and said file positioner including magnetic means on said flange for releasably coupling the file positioner any desired location on the file drawer.

9. A system as defined in claim 8 wherein the flange extends upwardly from the first segment.

10. A file positioner for attachment to a forward or rear wall of a file drawer, said file positioner comprising:

an integral body of plastic sheet material sufficiently sturdy to position files;

said body including a flange having opposite sides and lying generally in a plane;

means adhered to said flange and lying on one of said opposite sides of said flange for releasably coupling the body to any desired location on one of the forward or rear walls of the file drawer;

said body including a first segment joined to the flange and extending away from said flange on another of said opposite sides of said flange and a second segment joined to the first segment by a reverse bend and extending back toward said plane whereby the first and second segments at least partially circumscribe a region, said second segment extending substantially to said plane whereby said second segment can engage said one wall; and said flange and said first segment forming an obtuse included angle.

11. A positioner as defined in claim 10 wherein said flange extends away from said region.

12. A positioner as defined in claim 10 wherein the releasable coupling means includes a magnet.

13. A positioner as defined in claim 10 wherein the releasable coupling means includes hook and eye material.

14. A file drawer system for containing and positioning a plurality of file folders comprising:

a file drawer having a forward wall, a rear wall, at least one side wall and a bottom wall, said walls defining a filing compartment of predetermined width which is adapted to receive the plurality of file folders with a forwardmost and a rearwardmost of the file folders facing the forward and rear walls, respectively;

forward and rear positioners for positioning the file folders;

means for coupling the rear positioner to any desired location on at least one of said side, rear and bottom walls without penetrating said one wall and with the rear positioner lying between the rear wall and the rearwardmost file folder and being engageable with the rearwardmost file folder; and said forward positioner being between the forwardmost file folder and the forward wall and being engageable with the forwardmost file folder;

wherein the rear positioner has an inclined cam surface which faces forwardly and upwardly and which is spaced upwardly from said bottom wall and the forward positioner has an inclined cam surface which faces rearwardly and upwardly and which is spaced upwardly from said bottom wall.

* * * * *

UNITED STATES PATENT AND TRADEMARK OFFICE

CERTIFICATE OF CORRECTION

PATENT NO. : 5,067,780

DATED : Nov. 26, 1991

INVENTOR(S) : Brent N. Rickard

It is certified that error appears in the above-identified patent and that said Letters Patent is hereby corrected as shown below:

Column 6, line 51 change "drawing" to -- drawer --.

Column 7, line 2 after "positioner" insert -- to --.

Signed and Sealed this

Twenty-fifth Day of May, 1993

Michael K. Kirk

MICHAEL K. KIRK

*Acting Commissioner of Patents and Trademarks*

*Attest:*

*Attesting Officer*